US006293285B1

(12) United States Patent
Schach

(10) Patent No.: US 6,293,285 B1
(45) Date of Patent: Sep. 25, 2001

(54) HAIR STYLING ACCESSORY

(76) Inventor: Bernadine Schach, 269 Timberlake Dr., Azle, TX (US) 76020

( * ) Notice: Subject to any disclaimer, the term of this patent is extended or adjusted under 35 U.S.C. 154(b) by 0 days.

(21) Appl. No.: 09/688,749

(22) Filed: Oct. 16, 2000

(51) Int. Cl.[7] ..... A45D 8/34
(52) U.S. Cl. ..... 132/200; 132/275
(58) Field of Search ..... 132/273, 275, 132/200, 210; 63/5.1, 38; 223/48; D28/41

(56) References Cited

U.S. PATENT DOCUMENTS

| | | | | |
|---|---|---|---|---|
| D. 391,672 | * | 3/1998 | Nahoum | D28/41 |
| 3,301,266 | * | 1/1967 | Hoffman | 132/273 |
| 3,751,769 | * | 8/1973 | Reiner | 132/273 |
| 5,395,245 | * | 3/1995 | Heinz | 223/48 |
| 5,497,795 | * | 3/1996 | Hibbard | 132/275 |
| 6,009,882 | * | 1/2000 | Schine et al. | 132/273 |
| 6,041,792 | * | 3/2000 | Kennedy | 132/275 |
| 6,076,532 | * | 6/2000 | Thomas et al. | 132/273 |

* cited by examiner

*Primary Examiner*—Todd E. Manahan
(74) *Attorney, Agent, or Firm*—John L. Sigalos

(57) ABSTRACT

A device for styling hair in which a plurality of spacers are slidably mounted on parallel, longitudinally-disposed elastic strands which, when not in use, are normally not under tension. In the preferred embodiment, the spacers (e.g., beads) preferably are of at least two significantly different sizes and are disposed in a pattern according to which each bead (other than the two end beads) is adjacent to two beads of a different size or color thus facilitating identification when the device is being mounted on the hair at the back of a person's head. The number of spacers preferably is at least equal to one plus the number of locks of hair selected for inclusion and retention in a particular geometric styling configuration. In use, spacers are temporarily separated by stretching of the elastic strands so that selected locks of hair can be passed between the elastic strands and separated from other hair locks by inter-positioned spacers, the locks of hair being held in a desired position by pressure remaining after manually imparted tension has been released. Also included are methods of use of the device to effectuate selected hair styles.

26 Claims, 3 Drawing Sheets

HAIR STYLING ACCESSORY

BACKGROUND OF THE INVENTION

This invention relates to devices and methods for facilitating hair styling.

Hair styling accessory devices have heretofore been proposed, illustrative of which are the proposals of U.S. Pat. No. 5,303,723 granted Apr. 19, 1994 to Bernadine Schach and entitled "Hair Styling Device"; and U.S. Pat. No. 5,544,666 granted Aug. 13, 1996 to Bernadine Schach and also entitled "Hair Styling Device".

Although such proposals have addressed selected problems encountered in effectuating particular styles of hair, there has been a need to effectuate other attractive styles. Thus, where many locks of hair have been interlaced, or woven, such interlacing or interweaving has taken much time and attention. Moreover, such interlacing has required substantial time and attention in subsequent unlacing. In some instances unlacing has occurred inadvertently. Accordingly, there has continued to be a need for additional hair styling accessories that are simple, easy to use, and facilitate implementing selected modes of hair styling while facilitating retention of the hair in the intended styles.

BRIEF SUMMARY OF THE INVENTION

The improved devices and methods according to the invention hereof include simple and cost effective features that facilitate interlacing of hair locks in a variety of attractive patterns. This is accomplished by utilizing an implement herein identified as a hair lacer. The lacer comprises elastic strands normally disposed in close parallel proximity. Mounted on the strands are a plurality of apertured spacers of any of a variety of sizes and shapes. The strands extend through apertures in the spacers, the spacers being thus slidable along the strands so that they can be moved therealong by the user.

In accordance with one preferred embodiment, there is provided a hair styling accessory for separating locks of hair and holding them in selected relationship, the accessory comprising a pair of elastic strands disposed in parallel and a plurality of beads mounted on the strands; at least some of the beads being in close proximity to each other when the elastic strands are unstretched and providing spaces therebetween for insertion and temporary retention of said locks of hair when the elastic strands are stretched and for retention of the locks in separated relationship when tension on the elastic strands is released. Provision is also made for manual urging of beads toward each other to impart holding tension on locks of hair that may be positioned therebetween.

In accordance with another preferred embodiment hereof, there is described a method of implementing a hair style comprising separating hair into a plurality of discrete and separate locks; providing a pair of elastic strands mounted with a plurality of adjacent apertured spacers; imparting tension to the elastic strands to stretch the strands and increase spaces therebetween; individually passing separated hair locks through different ones of the spaces between adjacent spacers thereby disposing the locks in separated relationship; releasing the tension; and urging adjacent spacers together to temporarily fix the separated locks in position.

OBJECTS AND FEATURES OF THE INVENTION

It is one general object of the invention to facilitate hair styling.

It is another object of the invention to facilitate laced hair styles.

It is yet another object of the invention to provide cost effective solutions for selected hair styles.

It is still a further object of the invention to impart pleasing esthetics to selected hair styles.

Accordingly, in accordance with one feature of the invention, a versatile hair styling accessory is provided, thus facilitating the styling of hair.

In accordance with another feature of the invention, a plurality of separators, or beads, are disposed in adjacent positions on stretchable strands, thus facilitating the lacing of hair locks in desired positions.

Accordingly, in accordance with one feature of the invention, a hair styling implement is comprised of simple and easy to use components, thus contributing to ease of use and reduction in cost.

In accordance with another feature of the invention, the aforementioned beads may be of multiple colors and shapes and disposed in attractive color patterns and/or shapes, thus contributing to esthetics and attractiveness of completed hair styles.

In accordance with still a further features of the invention, steps in the styling of hair are rendered relatively simple and effective, thus facilitating use and versatility.

These and other objects and features of the invention will be apparent from the following description, by way of example of a preferred embodiment, with reference to the drawing.

DESCRIPTION OF A PREFERRED EMBODIMENT

As used herein, the term "spacer" means any perforated ornamental shape (ornaments) such as a bead, cube, animal shape, and the like, or combination thereof, with beads being preferred. The invention will be further described in connection with beads, it being understood that the other spacers are utilized in the same manner as the beads.

Figure 1:
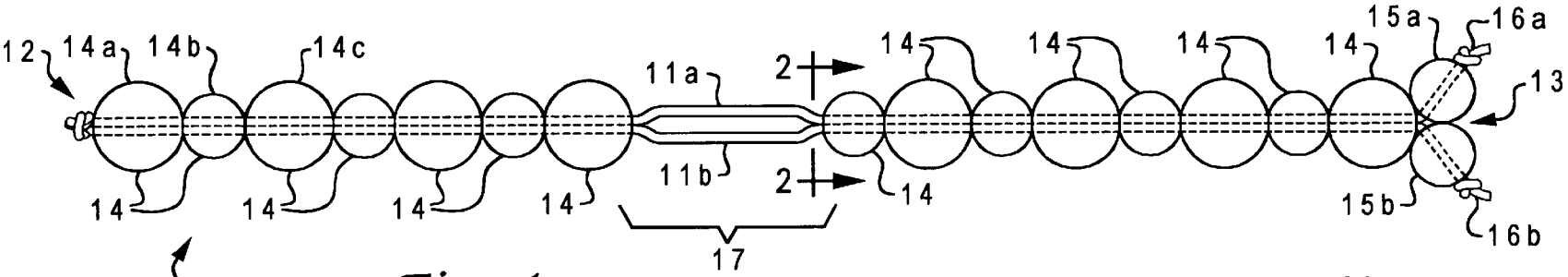
FIG. 1 is a view depicting the hair lacing accessory according to the invention.

Now turning to the drawing, and more particularly FIG. 1 thereof, it will be seen to depict a hair lacing accessory 10 according to the invention. There, it will be observed, are a pair of elastic strands 11*a* and 11*b* extending from one end 12 to the other end 13. On strands 11*a* and 11*b* there are mounted a plurality of beads 14 which, in the preferred embodiment hereof, are of at least two different sizes and colors. At one end 13, the strands are preferably terminated and secured by a pair of beads 15*a* and 15*b* through which the strands 11*a* and 11*b* respectively extend to conventional knots 16*a* and 16*b*. At the opposite end 12, the strands may be knotted or passed around the exterior of the adjacent bead so as to secure them in place. It is not necessary to have two terminating beads, 15*a* and 15*b*, since end 13 can be terminated with a single bead in the identical manner of end 12. It will be evident that more than two elastic strands can be used to contain even more locks of hair to vary the hair design, but two strands are preferred.

In FIG. 1, and in the preferred embodiment, a space 17 is shown between juxtaposed beads so as to facilitate use of the hair styling accessory as will be more particularly described below. However, it is not necessary that such a space be included if the strands 11*a* and 11*b* are made sufficiently elastic.

Further reference to FIG. 1 reveals that in the preferred embodiment, adjacent beads are spherical shapes of different sizes. Thus, for example, bead 14*a* is larger than bead 14*b*; and bead 14*b* is smaller than bead 14*c*. A similar alternating pattern preferably exists throughout so that each bead is adjacent a bead of a different size. Making the beads of different sizes facilitates use of the accessory by feel without the necessity for reference to a mirror. In addition to preferably making the beads of different sizes, in the preferred embodiment beads of more than one color are also employed. Such will be more apparent from reference to FIGS. 3–7. Moreover, the beads may be of different shapes such as cubes, pyramids, and the like, or an admixture of shapes.

Figure 2:
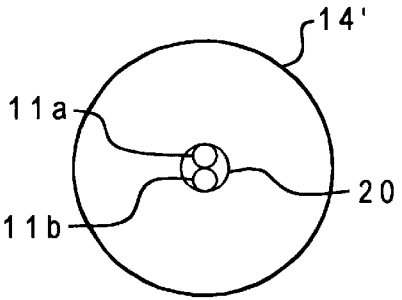
FIG. 2 is a section view taken along section lines 2—2 of FIG. 1.

Now turning to FIG. 2 which is a section view taken along section lines 2–2 of FIG. 1, one of the beads 14 is illustrated and designated as 14'. An aperture 20 extends entirely through the center thereof. Within such aperture are shown strings 11*a* and 11*b*. The aperture 20 and strands 11*a* and 11*b* are preferably sized so that they normally frictionally engage. Thus, the strands 11*a* and 11*b* together, when unstretched, are slightly larger than the interior dimension of aperture 20. When stretched, the diameters of the strands preferably decrease to facilitate movement and positioning of the beads along the strands. Thus, assembly of the accessory is facilitated by stretching the strands when the beads are originally mounted (slid) thereupon. At this point, it should also be noted that beads may be added or removed by untying knots 16*a*–16*b*, and either stretching the strands while threading one or more additional beads thereon or by sliding undesired beads from off the strands before re-tying knots 16*a*–16*b*.

In presenting a detailed description of the methods of use of the accessory, the following overview may be helpful. The following are some of the styles and patterns that may preferably be effectuated using the accessory: A River Braid, an Angel Lace; an Activity Braid; a Beaded Headband; a Loopy Beaded Headband; and Pony Beads. Two of these, the River Braid and Angel Lace are now described as examples.

Figure 3:
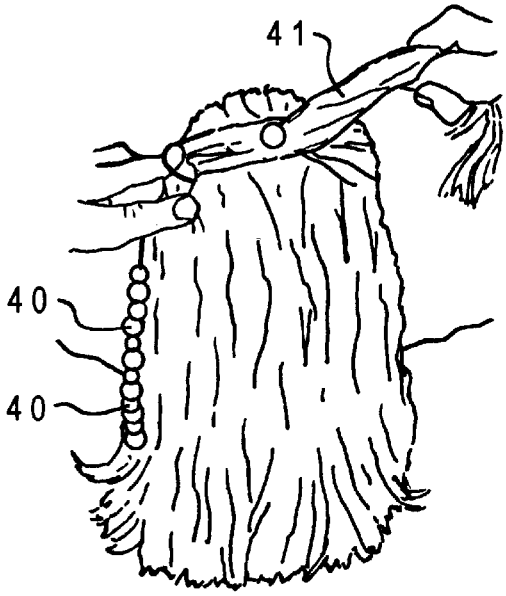
FIG. 3 is a view similar to that of FIG. 3A but showing a succeeding step in the styling of hair.
Figure 3A:
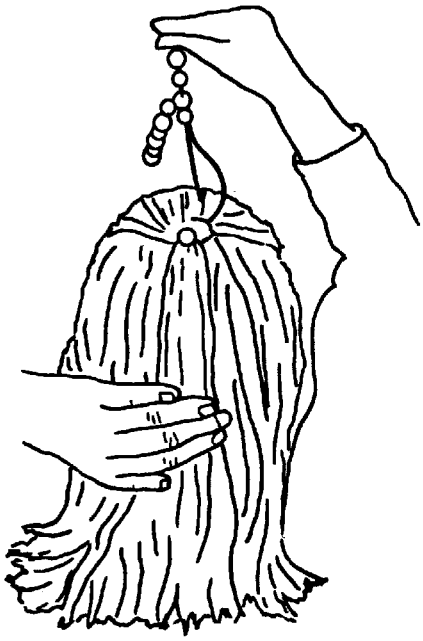
FIG. 3A is a view depicting the passing of a discrete separate lock of hair through a space formed between elastic strands of the hair lacing accessory of FIG. 1.

In one beginning step, the user moves down (to one end of the accessory) all of the beads except the top (end) bead, thus producing at the upper end an exposed interval (corresponding to interval 17 in FIG. 1). The exposed elastic strands are then pulled apart and a small lock of hair from the front center of the head is passed between the stretched-apart strings. The adjacent bead is then manually pushed up to hold the lock of hair in place. This step is illustrated in the upper part of FIG. 3A.

Figure 5:
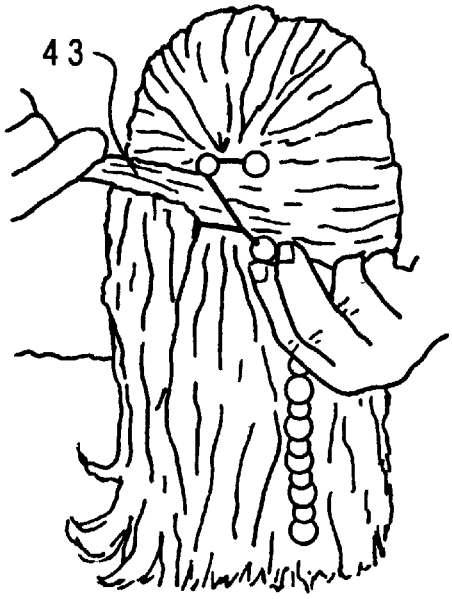
FIG. 5 is a view depicting an additional lock of hair in position between the next pair of beads.

For the aforementioned River Braid style, preparation begins with implementation of the above beginning step, after which the remaining beads 40 (FIG. 3) are pulled down to the lower end of the elastic strands. Then, a section 41 from one side of the head is parted off and pulled into a space created between the next adjacent beads. Such space may be created by stretching the strands; or it may be made by movement of beads along the strands. After the lock of hair is in place, it is locked in position by pushing an adjacent bead (FIG. 4) thereagainst. Another lock of hair 43 is then parted off from the opposite side of the head and similarly locked in position between the next two beads (FIG. 5). Again, one of the beads is urged (pushed) against the hair to tighten such lock in position. This procedure is continued sequentially (e.g., FIG. 6) so long as additional locks of hair are available until all of the hair is locked in place between successive beads, at which time the remainder or unused section of the accessory (if not all has been used in locking strands of hair in place) may be left dangling or wrapped around adjacent hair locks.

Figure 7:
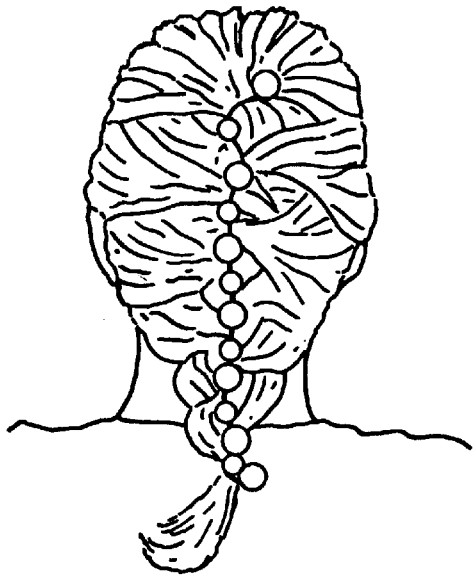
FIG. 7 is a view showing the completed Angel Lace configuration utilizing the hair lacing accessory according to the invention.
Figure 6:
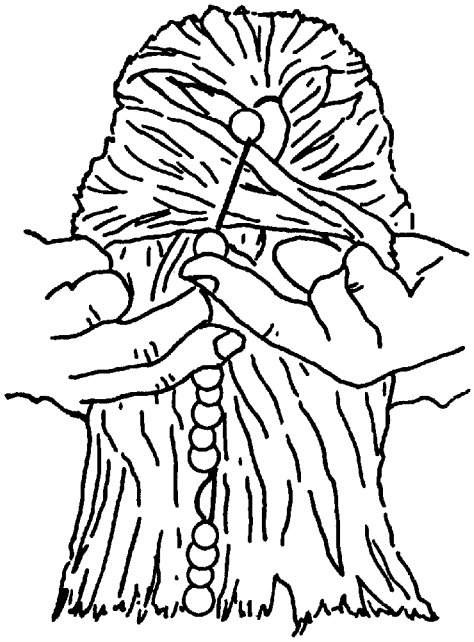
FIG. 6 is a view similar to that of FIG. 5 but showing an additional lock of hair from the opposite side of the head inserted between the next two beads.

The Angel Lace style begins with implementation of the above beginning step, after which sections of hair from both sides of the head are crossed as they are both passed through the same space formed between the strands and between the same two beads. (Generally illustrated in FIG. 4). Additional locks of hair from both sides of the head are crossed as they are passed through succeeding spaces until all the hair has been fixed. The completed Angel Lace hair style is illustrated in FIG. 7.

Figure 8:
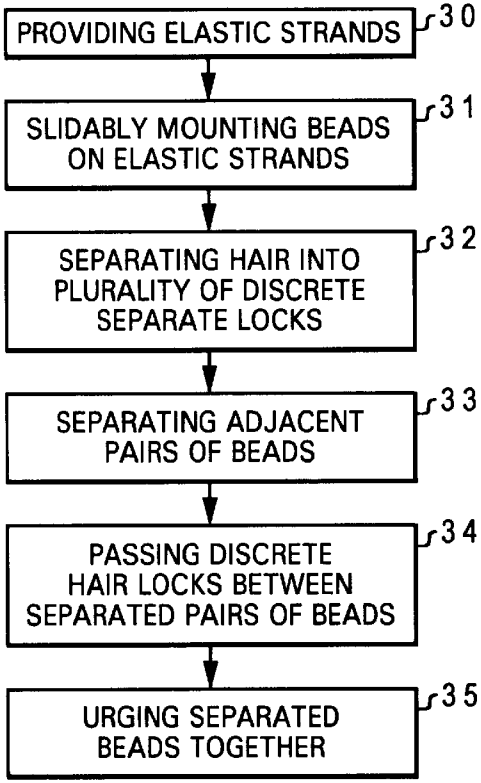
FIG. 8 is a is a chart summarizing steps employed in carrying out methods as illustrated in FIGS. 3–7.
Figure 4:
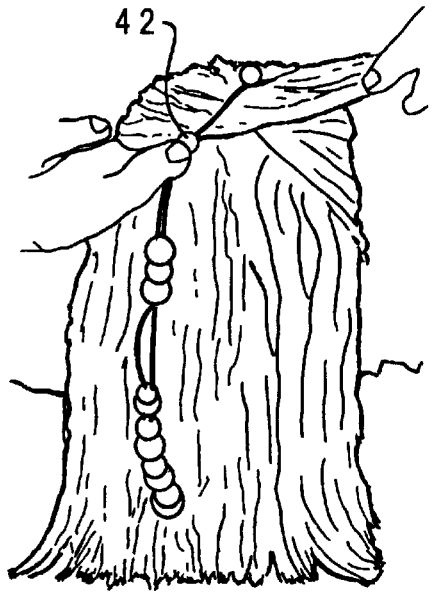
FIG. 4 is a view similar to that of FIG. 3 but showing the lock of hair in a slightly different perspective and with a bead pushed up to engage the hair lock.

As mentioned above, FIG. 8 is a chart summarizing steps employed in carrying out methods illustrated in FIGS. 3–7. The method includes providing elastic strands (indicated by block 30); slidably mounting a plurality of spacers (e.g., beads or ornaments) on the elastic strands as identified by block 31; separating hair into a plurality of discrete separate locks (block 32), separating adjacent pairs of beads or ornaments (block 33), passing discrete hair locks between separated pairs of beads or ornaments (block 34); and urging separated beads or ornaments together to disengageably maintain hair locks in position (block 35).

It will now be evident that there has been described herein an accessory and method for improving hair styling. Although the invention has been described by way of preferred embodiments, it will be evident that adaptations and modifications may be employed without departing from the spirit and scope thereof. Thus, for example, while in the preferred embodiments, beads of only two sizes and spherical shape are used (thus simplifying assembly of the accessories), it will be evident that beads of more than two different sizes or shapes could be employed without departing from the spirit and scope hereof. Moreover, the beads could be of the same color rather than of different colors as in the preferred embodiments. Further, the hair styling device can be sold as a kit containing elastic strands and beads of various sizes, shapes, and colors to permit the purchaser to assemble the hair styling device with colors and shapes of the purchaser's choosing.

The terms and expressions employed herein have been used as terms of description and not of limitation; and thus, there is no intent of excluding equivalents, but on the contrary it is intended to cover any and all equivalents that may be employed without departing from the spirit and scope of the inventions.

What is claimed is:

1. A hair styling accessory for separating locks of hair and holding them in side-by-side relationship, said accessory comprising elastic strands disposed in parallel and a plurality of perforated spacers mounted on said strands; the number of said spacers being at least equal to the number of said locks plus one; said spacers being in adjoining positions when said elastic strands are unstretched and providing spaces there between for insertion and temporary retention of said locks of hair when said elastic strands are stretched and for temporary retention of said locks in separated relationship when tension on said elastic strands is released.

2. A hair styling accessory according to claim 1 in which said spacers are beads slidably mounted on said strands.

3. A hair styling accessory according to claim 1 in which said spacers are colored beads.

4. A hair styling accessory according to claim 1 in which said spacers are beads of various colors.

5. A hair styling accessory according to claim 1 in which adjacent spacers are beads of different colors.

6. A hair styling accessory according to claim 1 in which said spacers are beads of a plurality of sizes and shapes.

7. A hair styling accessory according to claim 1 in which said spacers other than end spacers are each adjacent a spacer of a different size.

8. A hair styling accessory according to claim 7 in which every other spacer is a bead of the same size.

9. A hair styling accessory according to claim 1 in which said strands are normally disposed adjacent and in parallel.

10. A hair styling accessory according to claim 1 in which each of said spacers includes an aperture adapted for passing one of a pair of elastic strands therethrough.

11. A hair styling accessory according to claim 1 in which each of said spacers includes an aperture adapted for passing both of a pair of elastic strands therethrough.

12. A hair styling accessory according to claim 1 further including means for adding and removing spacers.

13. A hair styling accessory for separating locks of hair and holding them in side-by-side relationship, said accessory comprising a pair of elastic strands disposed adjacent and parallel to each other and a plurality of colored spacers slidably mounted on said strands; the number of said spacers being at least equal to the number of said locks plus one; said spacers being of at least two different sizes and each having an aperture therewithin adapted for passing said elastic strands therethrough; said spacers being in essentially adjoining positions when said elastic strands are unstretched and providing spaces therebetween for insertion and temporary retention of said locks of hair when said elastic strands are stretched and for temporary retention of said locks in separated relationship when tension on said elastic strands is released.

14. A hair styling accessory for separating locks of hair and holding them in side-by-side relationship, said accessory comprising a pair of elastic strands disposed in parallel and a plurality of spacers mounted on said strands; the number of said spacers being at least equal to the number of said locks; said spacers being in adjacent positions, said strands being of a length when unstretched to provide a space between two adjacent spacers sufficient for passage of a lock of hair therethrough, said strands further being of a length such that when said strands are stretched there are provided spaces therebetween for insertion and temporary retention of others of said locks of hair and for temporary retention of said locks in separated relationship when tension on said elastic strands is released.

15. A method of implementing a hair style comprising:

(a) separating human hair into a plurality of discrete and separate locks, (b) providing elastic strands mounted with a plurality of adjacent spacers;

(c) imparting tension to said elastic strands to stretch said strands and increase spaces therebetween;

(d) individually passing said separated hair locks through different ones of said spaces thereby disposing said locks in separated relationship; and (e) releasing said tension thereby to urge said strands together thereby temporarily affixing said separated locks in position.

16. The method of implementing a hair style according to claim 15 further including a step of urging said spacers toward one another further to fix said separated locks in position.

17. The method of implementing a hair style according to claim 15 further including a step of coloring said spacers in a plurality of different colors.

18. The method of implementing a hair style according to claim 17 further including a step of sizing said spacers in a plurality of differing sizes and/or shapes.

19. The method of implementing a hair style according to claim 18 further including a step of disposing said spacers on said strands to produce a pattern in which adjacent spacers are of different sizes and/or shapes.

20. The method of implementing a hair style according to claim 18 further including a step of disposing said spacers on said strands to produce a pattern in which adjacent spacers are of different colors.

21. The method of implementing a hair style according to claim 15 further including a step of sizing said spacers in a plurality of differing sizes and/or shapes.

22. The method of implementing a hair style according to claim 15 further including steps of adding and removing spacers.

23. The method of implementing a hair style according to claim 15 further including a step of manually sliding at least one of said spacers along said strands.

24. A method of implementing a hair style comprising:

(a) separating human hair into a plurality of discrete and separate locks;

(b) providing a pair of elastic strands mounted with a plurality of normally abutting perforated spacers;

(c) imparting tension to said elastic strands to stretch said strands and produce spaces between said normally abutting spacers;

(d) individually passing said separated hair locks through different ones of said spaces thereby disposing said locks in separated relationship; and (e) releasing said tension thereby to urge normally abutting spacers together thereby temporarily affixing said separated locks in position.

25. A method of implementing a hair style comprising:

(a) separating human hair into a plurality of discrete and separate locks;

(b) providing a pair of elastic strands mounted with a plurality of adjacent perforated spacers;

(c) moving one of said spacers along said strands to create a space between two of said adjacent spacers;

(d) passing one of said separated hair locks through said space;

(e) urging another of said spacers toward said one of said spacers and against said one of said separated hair locks thereby pressing against said one of said separated hair locks and holding said one of said locks in place;

(f) moving a third one of said spacers along said strands to create a second space between said third one of said spacers and said another of said spacers;

(g) passing a second one of said separated hair locks through said second space, and (h) urging said third one of said spacers along said strands toward said another of said spacers thereby pressing against said second one of said separated hair locks and holding said second one of said separated hair locks in place.

26. The method according to claim 25 further including:

(a) moving a fourth one of said spacers along said strands to create a third space between said fourth one of said spacers and said third one of said spacers;

(b) passing a third one of said separated hair locks through said third space; and (c) urging said fourth one of said spacers along said strands toward said third one of said spacers thereby pressing against said third one of said separated hair locks and holding said third one of said separated hair locks in place.

* * * * *